United States Patent [19]

Danforth

[11] Patent Number: 4,554,051

[45] Date of Patent: Nov. 19, 1985

[54] FIBER LENGTH INDICATING APPARATUS AND METHOD

[75] Inventor: Donald W. Danforth, Andover, Mass.

[73] Assignee: Bolton-Emerson, Inc., Lawrence, Mass.

[21] Appl. No.: 610,680

[22] Filed: May 16, 1984

Related U.S. Application Data

[63] Continuation of Ser. No. 361,300, Mar. 14, 1982, abandoned.

[51] Int. Cl.[4] ..... D21D 1/20; G01N 11/06; G01N 15/02

[52] U.S. Cl. ..... 162/49; 73/61 R; 73/63; 162/254; 162/263

[58] Field of Search ..... 73/63, 61.4, 61 R, 55, 73/53; 162/49, 198, 258, 254, 263

[56] References Cited

U.S. PATENT DOCUMENTS

| | | | |
|---|---|---|---|
| 1,580,166 | 4/1926 | Reid | 73/55 |
| 2,734,378 | 2/1956 | Meyers | 162/263 |
| 2,973,000 | 2/1961 | Pearson | 73/63 |
| 3,186,215 | 6/1965 | Danforth | 162/258 |
| 4,342,618 | 8/1982 | Karnis et al. | 162/263 |

*Primary Examiner*—Steve Alvo

*Attorney, Agent, or Firm*—Pearson & Pearson

[57] ABSTRACT

A standpipe is connected into a fiber processing system such as a pressurized stock line of a paper making system, containing refined stock, or unrefined pulp, at operating consistencies. Automatic controls cycle a measurement chamber, in the standpipe, through intake measure and exhaust. An imperforate plate mounted across the measurement chamber has at least one hole of predetermined cross dimension, or diameter, substantially equal to the relative length of fiber desired. Automatic timing establishes a set intake time for slurry, or suspension, to pass through the hole and contact lower and/or upper liquid level sensors, or other level indicators, in the chamber. Instantaneous, periodic read out is provided to indicate "too short", "too long" or "correct length" with each cycle. Differential pressure, across the hole, or orifice during measure, as well as approach velocity, is appropriately controlled.

19 Claims, 11 Drawing Figures

RELATIVE LENGTH TOO LONG (FAIL TO REACH LOWER PROBE)

RELATIVE LENGTH JUST RIGHT (REACHES LOWER BUT NOT UPPER)

RELATIVE LENGTH TOO SHORT (REACHES UPPER PROBE TOO SOON)

FIBER LENGTH INDICATING APPARATUS AND METHOD

RELATED APPLICATION

This application is a continuation of my application Ser. No. 361,300 filed Mar. 14, 1982, entitled "FIBER LENGTH INDICATING APPARATUS AND METHOD", now abandoned.

BACKGROUND OF THE INVENTION

In the grinding of rags and the like for the preparation of a furnish for roofing felt, for example, it is necessary to determine when the stock has arrived at desired condition. Threads that are too long are difficult to handle and result in an inferior product. Fibers that are too short drain slowly and interfere with efficient manufacturing. Presently, the only available method for determining quality is to manually examine a handful of stock. Not only is such procedure time consuming, but it is also most imprecise depending on the skill and experience of the operators involved. As a result, product quality is impaired, productivity is reduced and operating cost increased.

In recent years, continuous digesters have replaced batch digesters, i.e. wood chips and chemicals are continuously introduced to, and pulp is delivered from, a complex system of vessels, piping, etc. In many continuous pulp mills, a problem is encountered inasmuch as several species of wood are utilized and it is essential to segregate resulting pulp according to specie, i.e. a pulp made from softwood must be segregated from pulp made from sawdust, etc.

The problem is that, as it emanates from the pipeline, all pulps are virtually indistinguishable. There is, however, one factor which quantitatively identifies virtually all species, namely fiber length. By continuously monitoring fiber length of pulp as it passes through the pipeline, a change from one specie to another becomes immediately evident, positively precluding any possibility of a customer receiving incorrect pulp.

Thus, an instrument which will automatically monitor fiber length of refined paper stock, or of unrefined paper pulp, while in slurry form, at operating consistencies and while in the paper making system will obviously be most useful.

The principal object of this invention is to provide such an apparatus and method so that a signal is generated to inform the operator when a pulp interface passes, or that stock is refined to the correct fiber length and quality.

Use can be made of the signal to automatically control the refining effect of refiners to optimize, and maximize, uniformity.

It has, heretofore been proposed in U.S. Pat. No. 1,580,166 to Reid of Apr. 13, 1926 to provide a laboratory type device with a screen having elongated, narrow, slots, a tank entirely separate from a stock pipeline system and a vacuum mechanism for drawing stock through the screen. The slots are about one hundreth of an inch in width so that a dilute slurry is used and the stock is treated as discrete fibers, rather than as a fiber aggregate. The Reid device would not be capable of instantaneous "read out" in "on-line" operation since one would have to count, or weigh, the fibers which do not pass the screen.

In U.S. Pat. No. 2,973,000 to Pearson of Feb. 28, 1961, a sharp edged orifice plate is used to determine consistency of diluted stock in a laboratory type device. All of the fibers pass through the orifice without regard to length.

In U.S. Pat. No. 3,846,231 to Crosby et al of Nov. 5, 1974 the stock is drawn across a perforated partition to measure freeness just as in my two patents on freeness testers cited thereagainst namely U.S. Pat. No. 3,538,749 of October 1970 and U.S. Pat. No. 3,186,215 of June 1965 both to Danforth. No claim, or teaching, is made in these patents for measuring or monitoring fiber length.

A prior patent which more closely relates to measuring fiber length is U.S. Pat. No. 3,873,416 to Forgacs of Mar. 25, 1975 but the device requires the stock to be substantially diluted rather than at operating consistency in the paper making system. The Forgacs device works on a continuous flowing stream principle and not on a sampling sequence and makes use of a fractionating screen which is vertically oriented and vibrates.

As far as I am aware, none of the devices of the above patents are available in the trade and no instantaneous, automatic, "read-out" of fiber length, has been developed, except as disclosed herein.

There are no other references in the prior art, known to me, disclosing a device to monitor fiber length directly in the production system.

SUMMARY OF THE INVENTION

In this invention, an apparatus and method for monitoring the length of fibers in refined paper stock, or in unrefined paper pulp, is provided, wherein the read-out is instantaneous, and achieved periodically, while the fibrous slurry is in the paper making system at operating consistency.

Automatic controls are provided similar to those provided for the standpipe of my above mentioned patents on freeness testers, now well known in the trade as the "Drainac" manufactured by Bolton-Emerson, Inc. of Lawrence, Mass. In one embodiment of my freeness tester, an upstanding standpipe is mounted on a stock, or pulp, line with the lower end directly connected into the line and the upper portion forming a measurement chamber by reason of a transverse screen in the freeness tester. Timing control cycles the measurement chamber through intake by exhausting air therein to cause flow through the screen, a pair of electrodes sense the liquid levels attained by the filtrate and air pressure discharges the filtrate through the screen, thus transporting the fibers thereon back into the system.

If equalization of stock pressure is desired, the measurement chamber of the freeness tester can be exposed to ambient atmospheric pressure, rather than to negative pressure, and a constant level head box used between the stock line and the tester as in the Myers U.S. Pat. No. 2,734,378 of Feb. 14, 1956.

A significant feature of this invention is that instead of using a meshed screen, or a slotted plate, the fiber length indicator disclosed herein makes use of an imperforate plate extending across a measurement chamber and having at least one, orifice, or hole, of predetermined area or configuration preferably substantially circular, or tubular, cylindrical, and of predetermined cross dimension, or diameter, substantially equal to the relative length of the fiber to be detected as of changed specie or as of desired relative length.

When change of pulp specie in a pulp line is to be detected the upstanding container has its lower end directly connected into the system, with no by-passing or resort to laboratory manual testing. The fiber length indicator, or detector, automatically and periodically cycles through intake, measure and discharge with the electric probes, or other level sensing means, in the measurement chamber repeatedly signalling "correct" as long as the predetermined set intake time signals that the fiber length of the species is flowing. When another pulp species interface is encountered, it will result in fibers of a different length so that the read-out will be "incorrect length".

It will be udnerstood that a meshed screen, or multi-perforated plate corresponding to a screen, such as used in a freeness tester will not function as the partition across the measurement chamber of the fiber length indicator of this invention because the stock being measured is of high consistency and cannot be screened in the normal sense. A single orifice is sometimes preferred, but multiple such orifices of similar, or different, diameters such as four have usually been found preferable. The range of orifice diameters depends on the length of fibers to be measured and may range from one millimeter for extremely fine, synthetic fiber to about twenty millimeters for relatively unrefined rag fiber.

Since a single fiber processing mill may produce a number of different grades, the fiber length indicator of the invention may have a variety of replaceable plates, each with at least one substantially circular orifice of different diameter, or area to accomplish "coarse tuning" the fine tuning being accomplished by the operating variable of differential pressure across the orifice. Over a reasonable range, the same orifice can differentiate different fiber lengths depending on the driving force, the best operation appearing to be from 0.5 to 1.5 p.s.i.

DESCRIPTION OF A PREFERRED EMBODIMENT

Figure 1:
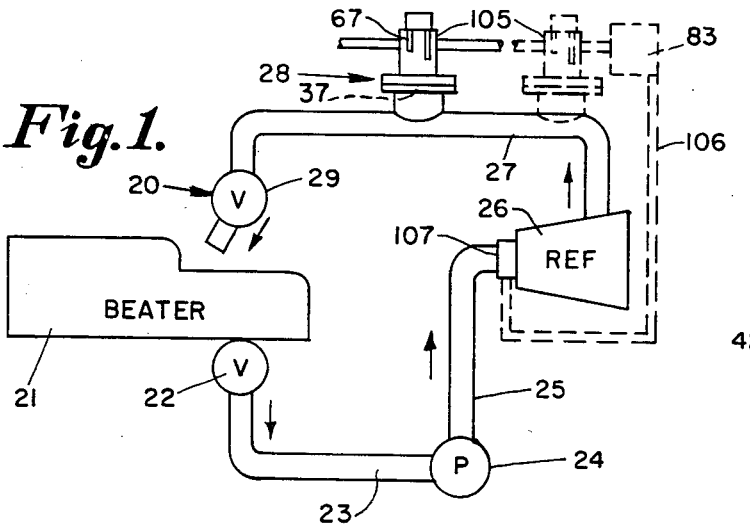
FIG. 1 is a diagrammatic view of an installation of the fiber length indicator of the invention in a closed paper stock line which includes a beater and a stock retainer.
Figure 7:
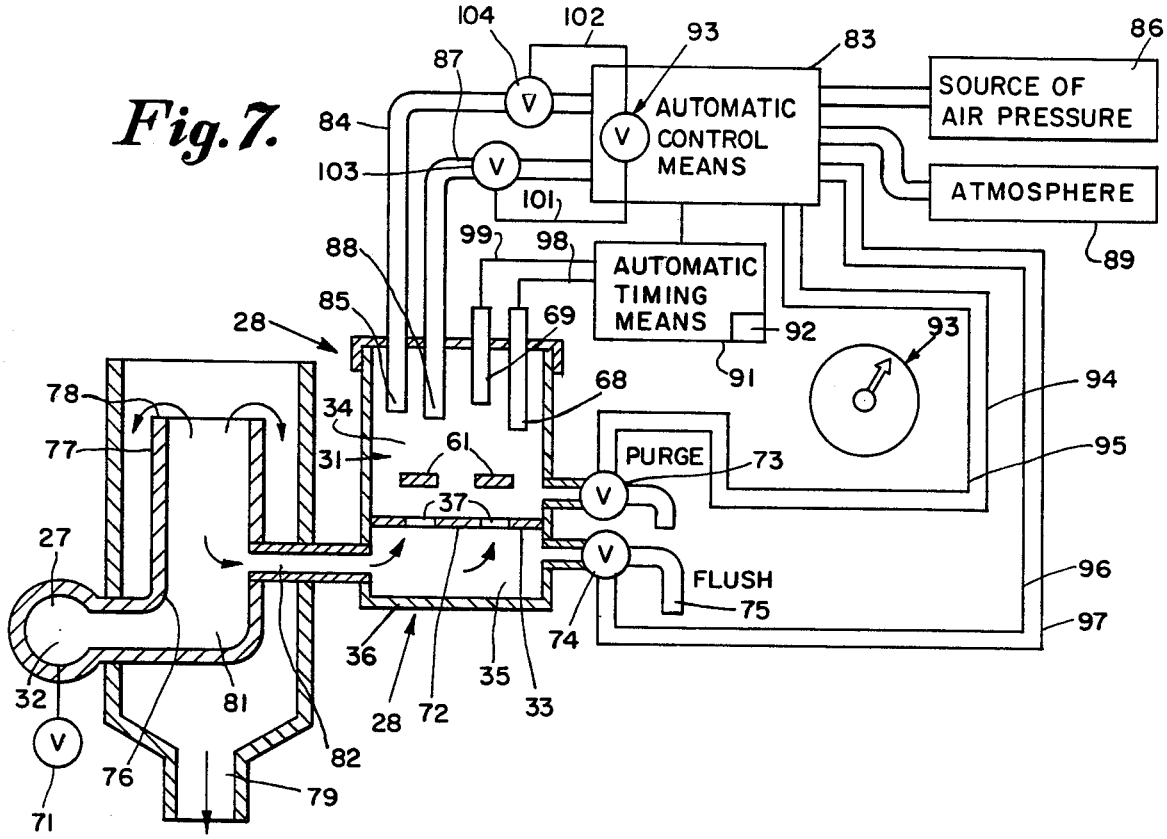
FIG. 7 is a diagrammatic view of a typical installation of the fiber length indicator in an open stock system.
Figure 11:
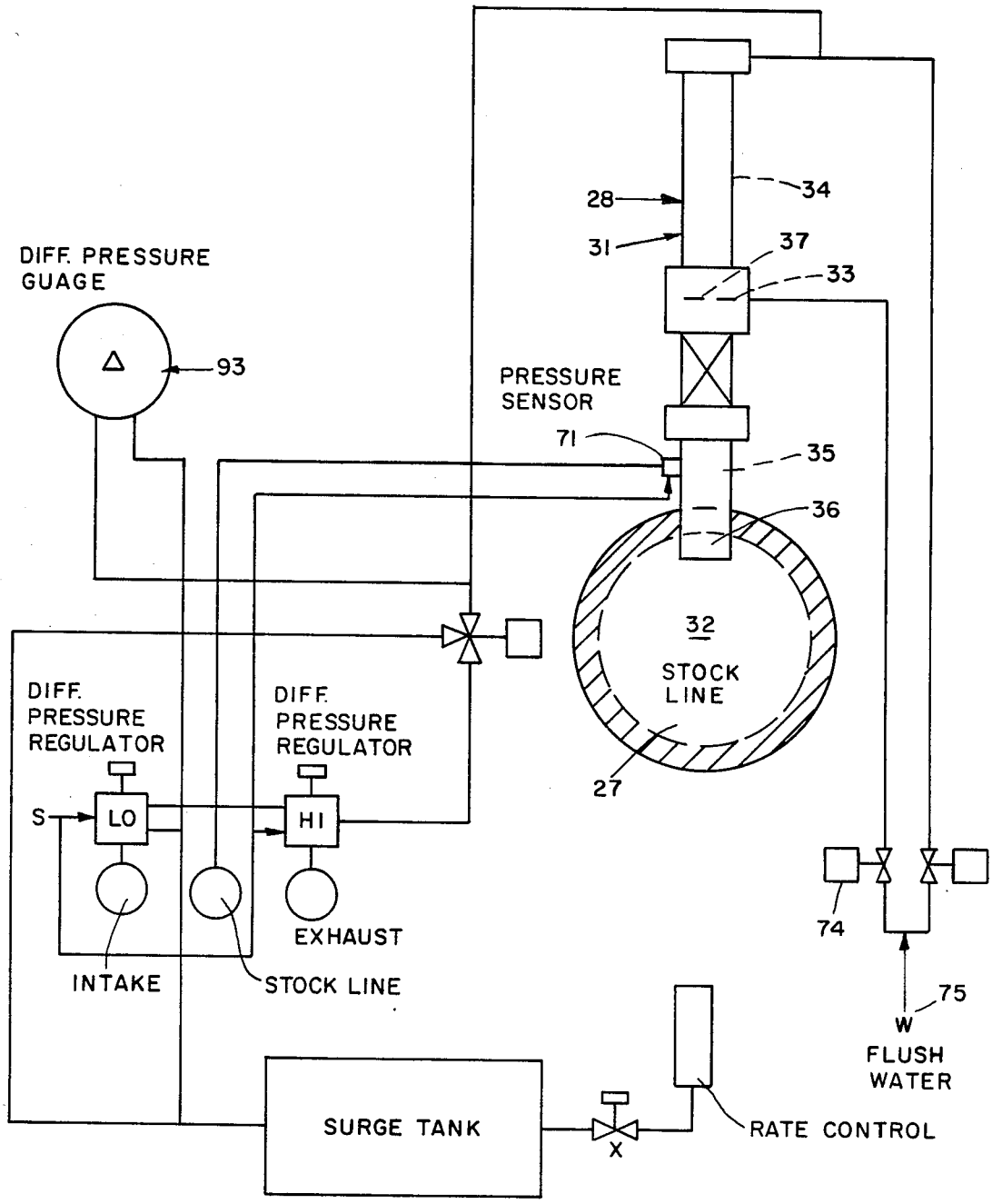
FIG. 11 is a diagrammatic view of the pneumatic/hydraulic control system for cycling the fiber length indicator of the invention in a typical paper stock system.

A paper stock system 20 is shown diagrammatically in FIG. 1, the system including a beater 21, valve 22, stock conduits 23, pump 24, conduit 25, and a stock refiner 26 of the disc, Jordan or "Claflin" type. The refiner 26 discharges into a conduit 27, conduit 27 having a fiber length indicator 28, of the invention, installed therein, with a control system such as shown in FIG. 7 or FIG. 11. Conduit 27 includes a valve 29 and discharges back into the beater 21 or elsewhere as desired.

Figure 2:
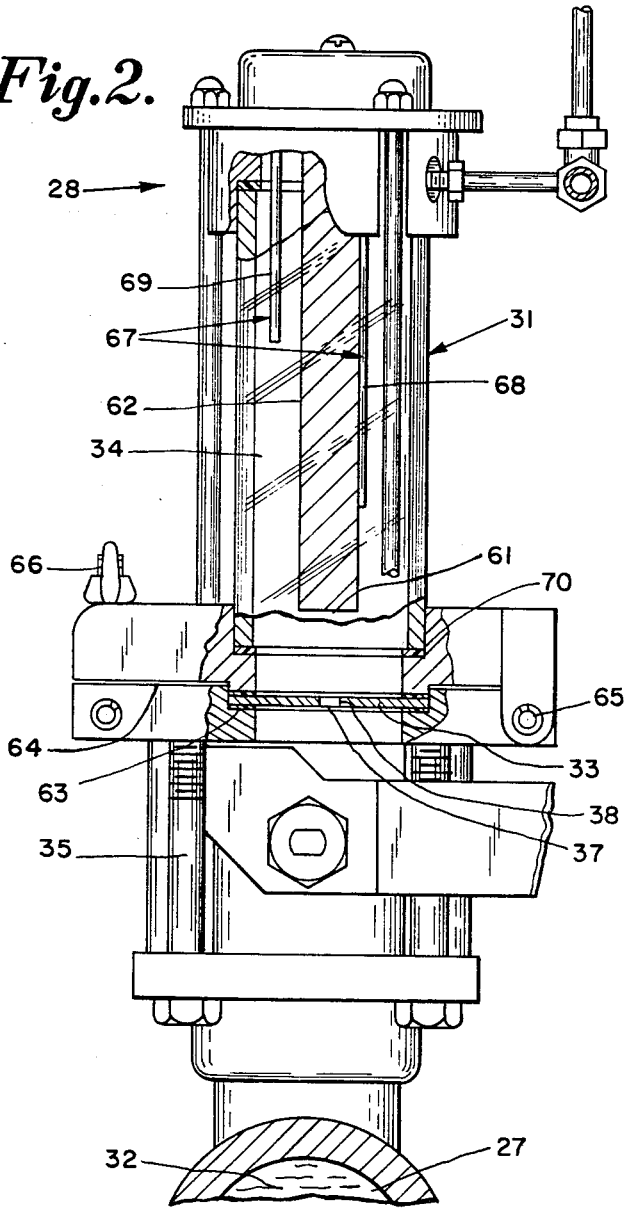
FIG. 2 is an enlarged, side elevation of the fiber length indicator with parts broken away for clarity.

As best shon in FIG. 2, the fiber length indicator 28, includes an upstanding, stock container 31, similar to the above mentioned "Drainac" freeness tester, and connected directly to a paper, or pulp, conduit 27, which forms a part of stock system 20, and contains paper stock, or pulp 32, at operating consistency so that it is relatively high consistency and has not been diluted for laboratory, or by-pass, testing.

The stock container 31 is divided, intermediate of its height, by an orifice plate 33, to form an upper portion 34, which is the measurement chamber, and a lower portion 35, the lower end 36 of the lower portion 35 being connected to the stock, or pulp, supply 27 to receive the stock, or pulp, 32 therefrom, at operating consistency and incorporate said lower portion into the paper, or pulp, conduit 27 of the paper stock system 20.

The orifice plate 33 is not a meshed, perforate screen, but instead is of imperforate material, such as metal, and includes at least one orifice 37 formed, by the rim 38 in the plate. The orifice 37 is preferably cylindrical and is of predetermined diameter substantially equal to the relative length of the fibers, such as 39, to be monitored in the measurement chamber 34. The orifice 37 could be of other shapes, configurations or cross sectional areas, such as triangular so long as it's cross dimension is of predetermined width corresponding to the predetermined relative length of the fiber to be measured, but a cylindrical orifice is found much preferable.

It should be understood that virtually all fiber slurries represent a range of fiber lengths from several millimeters to less than one millimeter with distribution similar to a probability curve. The shorter fibers pass the orifice while the longer fibers do not until eventually sufficient long fibers collect to prevent further passage. Thus, the volume of the stock passing the orifice is a measure of relative fiber length, other conditions being equal.

The slurry is not dewatered as a result of passing through the orifice. In operation in a fiber processing plant, plates each with a different sized orifice can be substituted in the fiber length indicator of the invention until a particular sized orifice, in the preset intake time indicates the desired relative length of fiber to meet the standards, or production requirements, of the processing plant. Thereafter, the same plate and orifice will repeatedly by cycled to monitor production and indicate any variation in quality revealed by a change of relative length of fiber in the slurry.

The tubular, cylindrical orifice 37, in each plate 33, has a diameter which is within the range of about twenty millimeters for rag fibers suitable for roofing felt base to one millimeter for highly refined flax pulp suitable for cigarette tissue.

Figure 5:
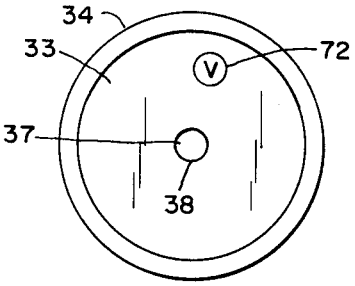

In FIG. 5, the diameter illustrated is about one millimeter for highly refined flax pulp suitable for cigarette tissue, or for fine synthetic fibers.

Figure 3:
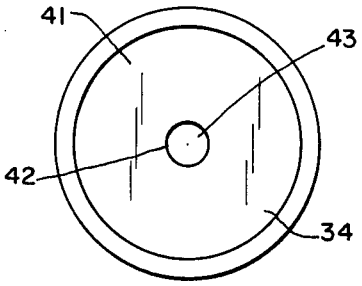
FIGS. 3, 4, 5 and 6 are fragmentary top plan views of the measurement chamber with orifice plates of different types and dimensions extending thereacross.

In FIG. 3 an orifice plate 41, similar to plate 33 is shown, wherein the rim 42 forms a substantially cylindrical orifice 43 of about twenty millimeters in cross dimension, or diameter, for use in measuring fibers in relatively unrefined rag pulp suitable for roofing felt base.

Figure 4:
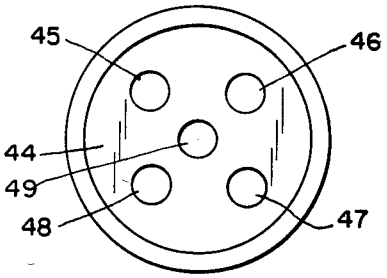

In FIG. 4, an orifice plate 44 is shown which is similar to plate 33 and 41 except that it is formed with a plurality of identical orifices, such as five, designated 45, 46, 47, 48 and 49, which may be circular, triangular square, or other configurations of relatively uniform cross dimension. Multiple orifices, of similar or different diameters, can be used to average out the testing the fiber length measurement results.

Figure 6:
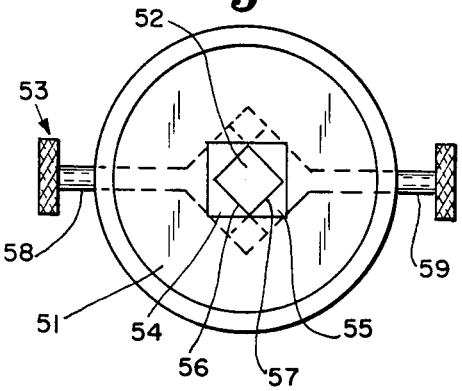

In FIG. 6, an orifice plate 51 is shown having an orifice 52 of variable area, configuration and cross dimension together with means 53 for varying the same. The orifice 52 may be formed as a camera shutter or preferably, as shown, by a pair of oppositely disposed, sliding gates 54 and 55 each with a V-shaped cut out 56 or 57 therein and actuated from outside the container, during operation by suitable push rods 58 or 59.

The orifices such as 37, 43, 45, and 52 are preferably of the standard type formed in thin plate with a downstream and upstream sharp square edge. They are not designed to create a jet but more properly might be designated holes or apertures.

Preferably a baffle, or target plate 61 is provided at a spaced distance above each orifice such as 37 to spread out and dampen any jet of paper stock or pulp up into the measurement chamber 34. The target plate 61 is preferably the lower end of a cylindrical, solid rod 62 supported from above, to avoid interference with incoming material.

A set of orifice plates such as 33, 41, 44 or 51, each with an orifice of different diameter, and perhaps totalling ten to twenty plates in the set, may be provided with each fiber length indicator 28. The plates are each seated in a plate recess 63 at the split 64 so that the upper portion 34 may be released and hinged rearwardly on hinge 65 to permit replacement of the plates in the set and refastened by bolt 66. The container 31 is not only separable at mid-height 64, but the upper portion is preferably a transparent tube seated on an annular gasket 70.

Slurry level sensing means 67 is provided within the upper portion, constituting the measurement chamber 34, and formed by at least one, and preferably by both a lower electric probe 68, and an upper electric probe 69. Other suitable slurry level sensing means may be used.

A differential pressure controller 71 (FIG. 11) is included in the system 20 to insure precision of control conditions. A differential pressure is essential (of the order of 1 p.s.i.) and while one can subtract pressure in the measurement chamber 34 from the line, or stock, pressure in stock, or pulp, line 27, the guage 71 avoids arithmetic error and makes the system simpler and more foolproof.

A check valve 72 may be incorporated with each orifice plate to prevent upstream passage anywhere through the plate except through the orifice but to permit ready downstream passage through the plate during the exhaust cycle back into the stock line.

A dump valve 73 may also be provided to facilitate discharge from the measurement chamber through an auxiliary opening during the exhaust cycle. A water valve 74 provides dilution water from a supply conduit 75 to flush out the parts and assure that all fibers are returned to the pipe line 27.

In FIG. 7 a fiber length indicator 28 of the invention is shown, connected into a paper stock, or paper pulp line 27 containing the high consistency liquid 32 to be measured, which may be at any line pressure, with the line pressure not affecting differential pressure.

The liquid 32 is directed into the upstanding open top tube 76 centrally located in the upstanding open top tube 77 so that it will flow over the rim 78 and into the discharge 79. Thus, the hydraulic head, or pressure, remains constant as the liquid is guided out of the bottom 81 of tube 76, into the lower portion 35 of container 31, by conduit 82.

The automatic control means 83 of the invention includes the air input tube 84 having one end 85 in chamber 34 and leading to a source of air pressure 86 such as mill air. It also includes the air exhaust tube 87, having one end 88 in chamber 34 and leading to the atmosphere or preferably to a source of negative air pressure 89.

The automatic timing means 91 is connected to the two probes, or electrodes 68 and 69 and the read out means is designated 92.

As shown diagrammatically, the automatic control means includes a cycle timer 93 of known construction, connected by suitable electric circuits and to conductors 94 and 95 to the purge, or dump, valve 73, conductors 96 and 97 to the water dilution valve 74, conductors 98 and 99 to the electrodes 68 and 69 and conductors 101 and 102 to the air input valve 103 and air exhaust valve 104 to actuate the same by suitable solenoids as programmed.

The automatic control means 83 is similar to the control means disclosed in my above mentioned U.S. Pat. Nos. 3,186,215 of June 1, 1965 and 3,538,749 of Nov. 10, 1970 in which the freeness tester disclosed therein is automatically cycled through intake, measure and exhaust.

Figure 8:
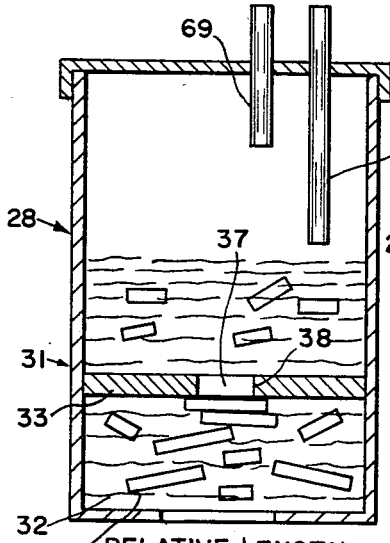
FIGS. 8, 9 and 10 are enlarged, diagrammatic, half-sectional views of the measurement chamber showing too long fibers, just right fibers, and too short fibers respectively.
Figure 9:
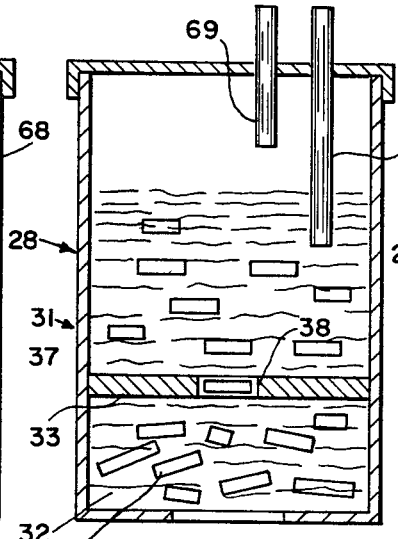

Thus, a suitable plate 33 having at least one orifice 37 with a cross dimension, and area, capable of passing fibers of substantially the correct relative length desired is installed in the seat, or recess 33, the indicator 28 closed and the cycle timer 93 actuated. The cycle timer then cycles the measurement chamber 34 through intake, measure and exhaust to obtain the desired automatic, periodic, instantaneous read out by opening air exhaust valve 104 to negative pressure, or atmosphere thereby enabling the fibers in the stock, or pulp, line to attempt to pass through each orifice 37 into the chamber 34. A predetermined set intake time for the cycle is established by the cycle timer so that if no stock passes through the orifice to reach lower probe 68 before expiration of the set intake time "blow down", or exhaust, is initiated and the read out signal "too long" is displayed at 92. This is the situation illustrated in FIG. 8.

Figure 10:
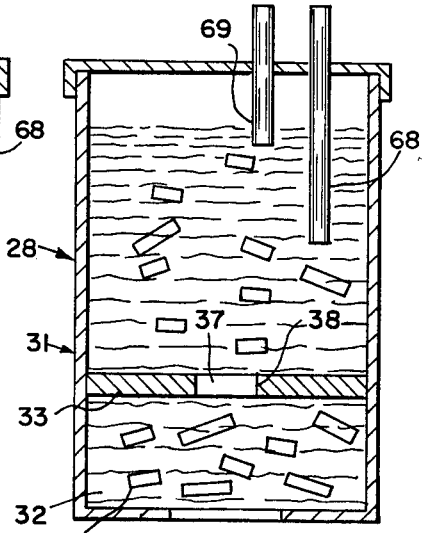

If the stock reaches the upper probe 69 before the set intake time of the timer expires, "blow down", is initiated and the signal "too short" is displayed on the read out 92 (FIG. 10).

If the stock reaches the lower probe 68 but not the upper probe 69 before the timer times out with the set intake time, blow down is initiated and the signal "just right", or its equivalent, is displayed on the read out 92.

The differential pressure between stock line pressure and measurement chamber pressure is indicated by the differential pressure guage 71 (FIG. 11) and controlled by the automatic control means 83 to be about 1 psi as compared to about 7 psi in the freeness tester of my said patents.

The check valve 72 in each orifice plate enables the one way return of stock from the chamber 34 back into the stock line 27 during the blow down or exhaust cycle and the dump valve 73 also enables rapid clearance of chamber 34 during exhaust. The cycle timer 93 is programmed to supply flush water through valve 74 to clear the plate and orifice of fibers, or fibrous mats, during the exhaust cycle also.

As mentioned above, a constant hydraulic head in the open inner tube, or container 76, in the arrangement of FIG. 7 assures that any variations in stock line pressure do not affect measurement in the container 31 shown in that view.

It will be understood that air pressure and water pressure are greater than line pressure. Intake time may be about ten seconds and exhaust time also about ten seconds and the fiber length indicator of the invention may be cycled at any desired intervals to provide a read out of exact fiber length passing through stock, or pulp line 37 and to warn the operator that a different type pulp is passing by the indicator.

As shown diagrammatically in FIG. 1, a precise control of the quality of stock produced by refiners such as 26 is obtained by periodically measuring fiber length in a stock line 27, with a fiber length indicator 28 of this invention, and periodically measuring freeness in the stock line 27, with a freeness tester 105 such as the "Drainac" of my above mentioned prior patents U.S. Pat. Nos. 3,538,749 and 3,186,215.

The freeness tester 105, shown in dotted lines, and the fiber length indicator 28, are shown as both connected to a control system such as illustrated in FIG. 7, including the control means 83 and a circuit 106 to the drive means 107 of the refiner so that refining effect is controlled automatically to compensate for any variations in fiber length or freeness.

I claim:

1. On line apparatus for periodic testing of the length of fibers in paper stock or pulp, while undiluted and at operating consistency in a pressurized line of a paper making system, said apparatus comprising:

an upstanding stock container having a lower end connected to a supply of said paper stock or pulp flowing in said pressurized line of said paper making system at operating consistency, undiluted, and of predetermined, relative fiber length, a stock chamber, having a lower portion and an upper portion, said lower end incorporating said lower portion of said stock chamber into said pressurized line of said paper making system and having liquid level sensing means within the upper portion of said chamber for sensing the time of arrival of stock levels therein;

an orifice plate mounted across said chamber to divide said chamber into said upper and lower portions, said plate being imperforate except for rimming around at least one circular orifice and up to about five identical said orifices each of predetermined diameter, substantially equal to the said predetermined relative length of the fibers in said stock, each said orifice being in the range of about one to twenty millimeters in diameter;

automatic control means, operably connected to said container for periodically cycling said chamber through intake, measure and exhaust;

means for periodically, instantaneously generating a signal representing relative fiber length in stock or pulp flowing through said pressurized pipe line;

and automatic timing means connected to said liquid level sensing means and to said means for generating a signal for displaying the value of stock accumulation in said upper portion of said chamber during a pre-set period of time.

2. Apparatus as specified in claim 1 wherein:

the orifice in each said orifice plate is of diameter of about five to twenty millimeters for rag fibers suitable for roofing felt base or unrefined rag fibers.

3. Apparatus as specified in claim 1 wherein:

said orifice plate includes four of said circular orifices to average out the passage of fibers through said orifice plate into the upper portion of said chamber.

4. Apparatus as specified in claim 1 wherein:

said orifice plate includes camera shutter type mechanism for adjusting the size of said orifice and means for actuating said mechanism from outside said apparatus.

5. Apparatus as specified in claim 1 wherein:

each said orifice is substantially a cylindrical tube in configuration.

6. Apparatus as specified in claim 1 wherein:

said automatic control means includes means for establishing a predetermined pressure differential between the pressure of stock supplied to the lower end of said container and pressure within the upper portion of said stock chamber;

whereby orifice size constitutes coarse adjustment while differential pressure constitutes fine adjustment of said apparatus.

7. Apparatus as specified in claim 1 wherein:

said apparatus includes means for maintaining a differential pressure, in said stock chamber of about 0.5 to 1.5 p.s.i.

8. Apparatus as specified in claim 1 wherein:

the orifice in said orifice plate is of a diameter of about one to two millimeters for highly refined flax pulp suitable for cigarette tissue.

9. On line apparatus for periodic testing of the length of fibers in paper stock or pulp flowing in a paper making system while pressurized, undiluted and at paper making consistencies, and of predetermined relative length said apparatus comprising:

an upstanding container having a lower end connected into said paper making system to receive said stock, or pulp, at operating consistency, pressurized, undiluted, and of predetermined relative fiber length the interior of said container being thereby incorporated into said paper making system;

an orifice plate mounted across the interior of said container, intermediate of the height thereof to form a measuring chamber thereabove, said plate being imperforate except for at least one orifice therethrough and up to about five identical said orifices therethrough each with a rim extending therearound, each said orifice being circular in configuration and of predetermined area with a diameter substantially equal to the predetermined relative length of said stock, or pulp, in said system, the diameter of said circular orifice being in the range between 1 mm and 20 mm;

liquid level sensing means in said measurement chamber for sensing liquid level reached therein by said undiluted stock, or pulp, at operating consistency;

automatic control means including a cycle timer operably connected to said measurement chamber for periodically cycling said chamber through intake, measure and exhaust, and establishing a set intake time for said predetermined relative fiber length;

means for periodically and instantaneously generating a signal representing relative fiber length in stock, or pulp, in said paper stock, or pulp system;

said control means including said means for generating a signal for signalling fiber length sensed during each said cycle.

10. Apparatus as specified in claim 9 wherein:

each said circular orifice is substantially tubular cylindrical in configuration.

11. Aparatus as specified in claim 9 wherein:

there are four orifices in said orifice plate for averaging out the testing of the fiber length measurement results.

12. Apparatus as specified in claim 9 wherein:

said automatic control means includes means for establishing a differential pressure across each orifice within the range of 0.5 to 1.5 psi.

13. Apparatus as specified in claim 9 wherein:

said container includes a dump valve operably connected to said measurement chamber for discharging the contents thereof; and said automatic control means includes means for actuating said dump valve during said exhaust cycle;

wherein the contents of said chamber are not discharged back through said orifice during exhaust.

14. Apparatus as specified in claim 9 wherein:

said container includes a flushing conduit mounted to direct a flushing stream of liquid across said plate to free said orifice of fibers collected thereon; and liquid supply means, forming part of said aromatic control means, for automatically flushing each said orifice during the exhaust cycle.

15. The on line method of automatically, periodically testing the length of fibers in refined, or unrefined, paper fiber slurry while in a paper making system and while pressurized, undiluted at operating consistencies and of predetermined relative fiber length, by means of a standpipe connected into said system, the standpipe having an orifice plate extending across the interior thereof with at least one circular orifice therein, and obtaining an instantaneous read out of said fiber length, said method comprising the steps of:

selecting as said plate of imperforate material having at least one circular orifice and up to about five identical said orifices, each of predetermined area and diameter substantially equal to the predetermined relative length of the fibers in said system, said diameter being in the range of 1 mm to 20 mm;

connecting said standpipe on line into said system for an intake, measure and exhaust cycle wherein said slurry must pass from said system through said circular orifice into a measurement chamber;

establishing a set intake time for measurement in said chamber for the said predetermined relative length of fibers;

measuring during each intake cycle, in comparison with said set intake time, whether said slurry passes through said orifice into said measurement chamber, in a predetermined volume or to a predetermined height therein;

and periodically, instantaneously generating a signal representing the relative fiber length in said slurry.

16. The on line method of automatically and periodically monitoring the relative length of fiber in refined paper stock, or in unrefined paper pulp, while at operating consistency, undiluted, and while pressurized in the paper making system, by means of a container connected into said system and having an orifice plate with a circular orifice therein, a measurement chamber and liquid level sensing means in said chamber which comprises the steps of:

selecting an orifice plate of imperforate material with from one to five identical circular orifices each having a diameter in the range of 1 mm to 20 mm which diameter is substantially equal to the predetermined relative length of fiber;

periodically and automatically cycling said measurement chamber through intake, measure and discharge to enable said undiluted stock, or pulp, at operating consistency to pass through said circular orifice from said paper making system into said chamber and contact said liquid level sensing means;

and periodically, instantaneously indicating, in response to said liquid level sensing means, at the end of said intake cycle, whether or not, fibers of said predetermined relative length have been sensed thereby.

17. On line apparatus for controlling the quality of paper stock discharged from stock refiners, said apparatus comprising:

a paper stock supply system containing pressurized, undiluted stock at normal operating consistency and including a stock refiner having a pair of members rotatably movable relative to each other;

means for driving one of said members with respect to the other member;

means for changing the refining effect of said refiner;

on line fiber length indicating means connected into said stock supply system for periodically measuring the relative length of the fibers in the stock passing through said system, said means including a plate of imperforate material having a substantially cylindrical aperture with a diameter in the range of 1 mm to 20 mm and substantially equal to the predetermined relative length of fibers to be refined, means for sensing the time of passage of stock through said aperture as compared to a predetermined time interval;

means for periodically, instantaneously generating a signal representing relative fiber length in said stock;

and control means for operatively connecting said sensing means, said means for generating a signal, and said measuring means with said means for changing the refining effect of said refiner to compensate for any variations of length of fiber supplied thereto with the predetermined relative length of fiber supplied thereto.

18. Apparatus as specified in claim 17 wherein:

said system also includes an on line freeness tester, said on line freeness tester and said on line fiber length indicating means, being connected into a paper line of said stock supply system, and jointly operatively connected to said means for changing the refining effect of said refiner to automatically continuously and instantaneously control both freeness and fiber length of the refined product of said system.

19. Apparatus for periodic testing of the length of fibers in paper stock or pulp in a supply thereof of predetermined relative fiber length, said apparatus comprising:

an upstanding stock container having a lower end connected to said supply of paper stock, or pulp, of predetermined relative fiber length, a stock chamber having a lower portion and an upper portion, liquid level sensing means within the upper portion of said chamber for sensing the time of arrival of stock levels therein;

an orifice plate mounted across said chamber to divide said chamber into said upper and lower portions, said plate being imperforate except for having one to five identical, circular orifices therethrough, each of predetermined diameter equal to the said predetermined relative length of the fibers in said stock or pulp, each said identical circular orifice having an identical diameter in the range of, one to twenty millimeters;

automatic control means, operably connected to said container for periodically cycling said chamber through intake measure and exhaust of said stock or pulp;

means for periodically, instantaneously generating a signal representing relative fiber length in said stock or pulp in said supply;

and automatic timing means connected to said liquid level sensing means and to said means for generating a signal for displaying the value of stock accumulation in said upper portion of said chamber during a pre-set period of time.

* * * * *